US007861622B2

(12) United States Patent
Chervenak et al.

(10) Patent No.: US 7,861,622 B2
(45) Date of Patent: Jan. 4, 2011

(54) LOCKING PLIERS

(75) Inventors: Thomas M. Chervenak, Stanley, NC (US); David P. Engvall, Stanley, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 12/180,836

(22) Filed: Jul. 28, 2008

(65) Prior Publication Data

US 2010/0018363 A1 Jan. 28, 2010

(51) Int. Cl.
*B25B 7/12* (2006.01)
*B25B 7/14* (2006.01)

(52) U.S. Cl. ..... 81/367; 81/318

(58) Field of Classification Search ..... 81/367, 81/315, 318, 349, 364, 405, 324, 372–380
See application file for complete search history.

(56) References Cited

U.S. PATENT DOCUMENTS

| | | | | |
|---|---|---|---|---|
| 2,489,057 | A | 11/1949 | St. Laurence | |
| 2,519,630 | A * | 8/1950 | Boyer | 81/373 |
| 2,584,353 | A | 2/1952 | Keiser | |
| 2,727,417 | A | 12/1955 | Eifel | |
| 2,854,877 | A * | 10/1958 | Hunt | 81/383.5 |
| 3,176,551 | A | 4/1965 | Hansen | |
| 3,192,805 | A | 7/1965 | Manning | |
| 3,710,658 | A * | 1/1973 | Wilson | 81/367 |
| 4,070,933 | A | 1/1978 | Macintosh | |
| 4,232,573 | A | 11/1980 | Dace, Jr. et al. | |
| 4,296,655 | A | 10/1981 | Tesoro | |
| 4,438,669 | A | 3/1984 | Hastings, deceased et al. | |
| 4,603,607 | A | 8/1986 | Schaffner, Jr. | |
| 4,662,252 | A | 5/1987 | Warheit | |
| 4,719,827 | A | 1/1988 | Igarashi | |
| 4,753,140 | A | 6/1988 | Majima | |
| 4,890,519 | A | 1/1990 | Le Duc | |
| 4,893,530 | A | 1/1990 | Warheit | |

(Continued)

FOREIGN PATENT DOCUMENTS

DE 9003713 U1 5/1990

(Continued)

OTHER PUBLICATIONS

European Patent Office, European Search Report, Feb. 11, 2010.

(Continued)

*Primary Examiner*—David B Thomas
(74) *Attorney, Agent, or Firm*—Dennis J. Williamson; Moore & Van Allen, PLLC

(57) ABSTRACT

A lockable pliers comprises a fixed assembly comprising a first handle supporting a first jaw. A second jaw is movable relative to the first jaw between an open position and a closed, locked position. A second handle is movable relative to the first handle and is connected to the second jaw at a fixed pivot. A toggle-link locking mechanism locks the second jaw in the closed, locked position. A movable pivot connects the second jaw to the fixed assembly such that the second jaw can move relative to the fixed assembly when the second jaw is in the closed, locked position and a torque is applied to the pliers.

8 Claims, 3 Drawing Sheets

U.S. PATENT DOCUMENTS

| | | | | |
|---|---|---|---|---|
| 4,901,609 | A | 2/1990 | Crum | |
| 4,922,770 | A | 5/1990 | Dlugolecki et al. | |
| 5,060,543 | A | 10/1991 | Warheit | |
| 5,134,908 | A | 8/1992 | Fisher | |
| 5,351,584 | A | 10/1994 | Warheit | |
| 5,456,144 | A * | 10/1995 | Dahl et al. | 81/373 |
| 5,660,089 | A | 8/1997 | Chow | |
| 5,850,768 | A | 12/1998 | Chow | |
| 6,000,303 | A | 12/1999 | Chang | |
| 6,019,020 | A | 2/2000 | Liou | |
| 6,101,908 | A | 8/2000 | Azkona | |
| 6,161,455 | A | 12/2000 | Ping | |
| 6,199,458 | B1 | 3/2001 | Wrigley et al. | |
| 6,199,459 | B1 | 3/2001 | Azkona | |
| 6,212,978 | B1 | 4/2001 | Seber et al. | |
| 6,227,081 | B1 | 5/2001 | Bally et al. | |
| 6,279,431 | B1 | 8/2001 | Seber et al. | |
| 6,311,588 | B1 * | 11/2001 | St. John et al. | 81/409 |
| 6,318,217 | B1 | 11/2001 | Emhardt et al. | |
| 6,327,943 | B1 | 12/2001 | Wrigley et al. | |
| 6,378,404 | B1 * | 4/2002 | Bally et al. | 81/355 |
| 6,467,380 | B1 | 10/2002 | Azkona | |
| 6,892,609 | B2 | 5/2005 | Kuo | |
| 7,040,201 | B2 | 5/2006 | Engvall et al. | |
| 7,100,480 | B2 | 9/2006 | Engvall et al. | |
| 2002/0139227 | A1 | 10/2002 | Azkona | |

FOREIGN PATENT DOCUMENTS

| | | | |
|---|---|---|---|
| DE | 9113870 | U | 12/1992 |
| DE | 19909224 | A1 | 9/2000 |
| DE | 19963818 | A1 | 7/2001 |
| DE | 20201841 | U1 | 8/2002 |
| DE | 202004015521 | U1 | 10/2005 |
| DE | 202005013501 | U1 | 11/2005 |
| EP | 0216717 | A | 4/1987 |
| FR | 2218971 | A | 9/1974 |
| GB | 27941 | | 7/1914 |
| GB | 2166382 | A | 5/1986 |
| GB | 2334913 | A | 9/1999 |
| WO | 9518699 | A1 | 7/1995 |
| WO | 9944790 | A1 | 9/1999 |

OTHER PUBLICATIONS

European Search Report, Oct. 29, 2009.
Australian Government, IP Australia, Examination Report, Sep. 3, 2010.

* cited by examiner

LOCKING PLIERS

This invention relates generally to locking pliers and, more particularly, to a locking pliers having an improved grip on the work piece.

BACKGROUND

Pliers-type hand tools with toggle-locking mechanisms are generally known as locking pliers. These pliers usually comprise a fixed handle having a fixed jaw on one end thereof. A movable handle pivots a movable jaw relative to the fixed handle to open and close the jaws. To grip a workpiece the handles are tightly compressed such that the linkage of the toggle-locking mechanism locks the pliers onto the workpiece. Adjustments in the force applied by the jaws to the workpiece are generally made by turning an adjusting screw mounted in the fixed handle that engages the toggle locking mechanism. The adjusting screw is translated relative to the fixed handle to modify the physical dimensions of the toggle mechanism to vary the effective length of the linkage of the toggle-locking mechanism. This adjustment varies the distance between the ends of the toggle linkage to vary the force applied by the jaws to the workpiece when the tool is locked. The pliers will remain firmly locked in place without the continuous application of force by the user.

SUMMARY OF THE INVENTION

A locking pliers comprises a fixed assembly comprising a first handle supporting a first jaw. A second jaw is movable relative to the first jaw between an open position and a closed, locked position. A second handle is movable relative to the first handle and is connected to the second jaw at a fixed pivot. A toggle-link locking mechanism locks the second jaw in the closed, locked position. A movable pivot connects the second jaw to the fixed assembly such that the movable jaw can pivot around the movable pivot. The movable pivot and second jaw can move relative to the fixed assembly such that the movable jaw is moved closer to the fixed jaw. When the second jaw is in the closed, locked position and a torque is applied to the pliers, the movable pivot moves relative to the fixed assembly to tighten the grip of the jaws on the work piece.

A method of gripping a workpiece with a locking pliers comprises providing a fixed assembly comprising a first handle supporting a first jaw. A second jaw movable relative to the first jaw between an open position and a closed, locked position is provided. A second handle movable relative to the first handle and connected to the second jaw at a fixed pivot is also provided. A toggle-link locking mechanism is provided for locking the second jaw in the closed, locked position. A movable pivot is provided for connecting the second jaw to the fixed assembly. A torque or turning force is applied to the pliers. The second jaw is allowed to move relative to the fixed assembly when the second jaw is closed and locked in position and the torque or turning force is applied to the pliers. The torque or turning force causes the gripping force between the jaws to increase.

DETAILED DESCRIPTION OF EMBODIMENTS OF THE INVENTION

Figure 1:
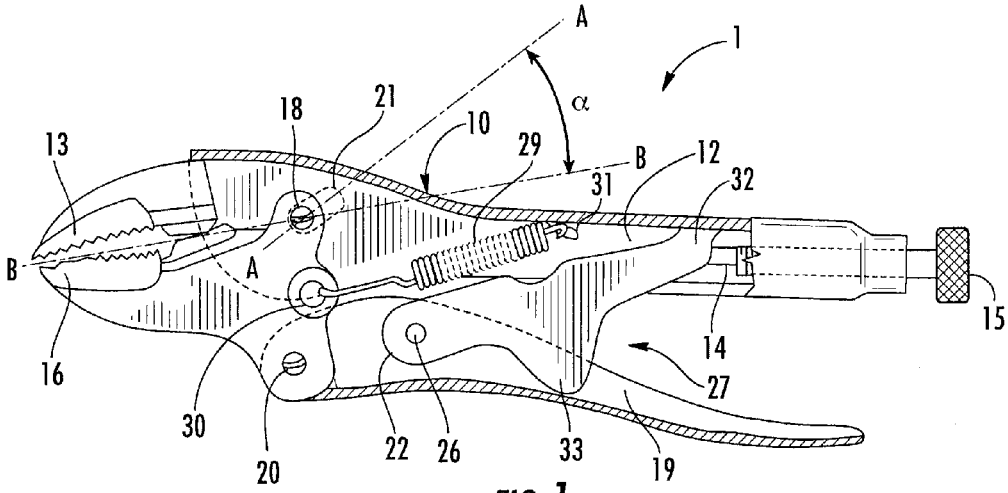
FIG. 1 is a partially cut-away side view of one embodiment of a locking pliers according to the present invention in the closed and locked position.

Pliers 1 include a fixed assembly 10 having a fixed handle 12 at one end and a fixed jaw 13 at the other end. A movable handle 19 is pivotably connected at one end to a movable jaw 16 by pivot pin 20. The jaws may have any shape where the tight grip function of the invention is useful.

A pivot pin 18 connects the movable jaw 16 to the fixed assembly 10. The fixed assembly 10 includes a slotted aperture 21 for receiving the pivot pin 18 such that the pivot pin 18 can move in slotted aperture 21 to increase the gripping force exerted on a work piece during use of the pliers as will hereinafter be described. The movable jaw 16 rotates about an axis of rotation that extends through the axis of pin 18 and moves in the aperture 21 such that the axis of rotation can move in the aperture 21. The slotted aperture 21 has the shape of an oval hole where the long axis of the aperture A-A extends generally towards the rear of the pliers and is disposed such it is arranged at an angle $\alpha$ where angle $\alpha$ is the angle between the long axis A-A of the aperture 21 and a line B-B that extends through the center of the closed jaws. The angle $\alpha$ can be varied to thereby change the spacing between jaws 13 and 16 at which the maximum gripping force is applied. In one embodiment angle $\alpha$ is approximately 15°. The pin 18 is dimensioned such that it is constrained to move substantially along the long axis A-A of the aperture 21. As used herein "front" or "frontward" means generally toward jaws 13 and 16 and "rear" or "rearward" means generally toward handles 12 and 19. While the aperture jaw is described as a slotted aperture, the aperture 21 can have a different shape than the slot illustrated in the figures provided the shape allows the pivot pin to move such that the movable jaw moves toward the fixed jaw. One alternate shape for aperture 21 is arcuate where the center of the arc of the aperture is located at pin 20.

A toggle locking mechanism 27 locks the fixed jaw 13 relative to the movable jaw 16. A link 22 is pivotably connected to the movable handle 19 by a pivot pin 26. The opposite end 32 of link 22 is in sliding and pivoting contact with the end of adjustment screw 14. A projection 33 extends transversely to the length direction of the link 22 and acts as a stop when the jaws are in the closed position by making contact with the handle 19. A biasing spring 29 extends between an opening 30 on the movable jaw 16 to a tab 31 protruding from fixed handle 12. The spring 29 applies a bias which tends to move the jaws 13 and 16 away from one another.

When the jaws 13 and 16 are in the open position, the pivot points, 18, 20, 26 and the point of contact between the end 32 of link 22 with the end of the adjusting screw 14 are arranged as a polygon. When the jaws are in the closed position, the pivots 20, 26 and the point of contact between link 22 and screw 14 are substantially in a straight line with the pin 26 in an over-center position where it is positioned slightly inside (toward fixed assembly 10) of the line between pivot 20 and the point of contact between link 22 and the screw 14. The jaws 13 and 16 cannot be pried apart from the locked position by use of force which pulls or pushes on the jaws 13 and 16 because separation of the jaws is prevented by the over-center condition of the pin 26. However, the jaws 13 and 16 may be separated by applying a force to the movable handle 19 in a direction which moves the movable handle 19 away from the fixed handle 12. A configuration of the pivots which places the mechanism in a locked position when the jaws are closed or grasping a workpiece can be considered an over-center mechanism when force applied directly to the jaws is not effective in separating the jaws. The jaws can only be opened by forces acting on the links of the mechanism. Other locking mechanisms are known and may also be used to lock the handles relative to one another. For example, the linkage may include a release lever to facilitate the unlocking of the links and/or the locking mechanism may include a compound linkage for effecting the locking function.

The end of the fixed handle 12, remote from the jaw 13, is completed with a threaded circular aperture through which threaded adjustment screw 14 is threadably engaged. The screw 14 terminates in an adjusting knob or head 15. The end 32 of the link 22 is slidably and pivotably engaged with the end of the adjusting screw 14. As is apparent from the drawing, turning the adjusting screw 14 changes the distance between the end 32 of the link 22 and the pivot point 18 of the movable jaw 16, whereby the jaws may be adjusted to grip objects of different dimensions with varying force.

Figure 2:
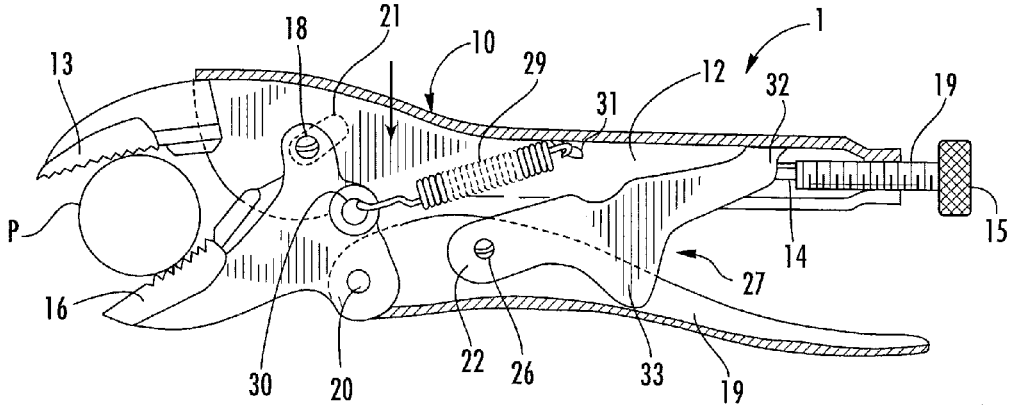
FIG. 2 is a partially cut-away side view of an embodiment of a locking pliers according to the present invention in its closed, locked position on a workpiece.

The operation of the locking pliers will be explained with reference to the figures. The locking pliers are shown locked on a work piece P (FIG. 2) such as a pipe although the pliers will operate in a similar fashion for any shaped and sized work piece. In the locked position, the jaws tightly engage the work piece P and the toggle locking mechanism 27 is in the locked, over-center position where the pliers maintain the locked position without the application of force by the user. In existing locking pliers, when a turning force is applied to the pliers in the direction of arrow A, the jaws can lose purchase and "slip" over the work piece.

In operation of the pliers of the invention, when the pliers are first locked on a work piece the pivot pin 18 moves in slot 21 fully toward the front of the pliers. When a turning force or torque is applied to the pliers, the pivot pin 18 moves toward the rear of the pliers but pivot pin 18 does not move all of the way to the rear end of the slot 21. The movable jaw 16 rotates slightly around pivot pin 20 (clockwise as viewed in the figures) to allow movement of pivot pin 18 in slot 21. As pivot pin 18 moves in slot 21, the movable jaw 16 is also moved in the same direction. The movable jaw 16 moves rearward and, due to the angle of the slot 21 relative to the fixed jaw 13, jaw 16 also moves toward the fixed jaw 13. As the movable jaw 16 moves toward the fixed jaw 13, the gripping force on the work piece increases as the distance between the jaws (or the volume of the space between the jaws) decreases. To increase the gripping effect of the pliers, the gripping faces 13*a* and 16*a* are configured such that the distance between the jaws becomes smaller toward the front of the pliers. As a result, as the jaw 16 moves rearward, the distance between the jaws also narrows due to the geometry of the jaws as well as the movement of jaw 16 toward jaw 13. Such an arrangement can be used with any of the embodiments of the invention.

Figure 3:
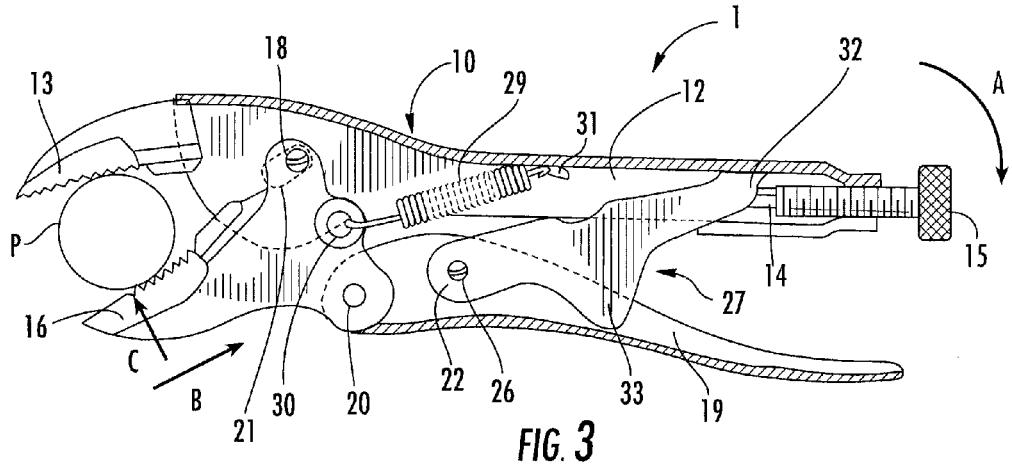
FIG. 3 is a partially cut-away side view of an embodiment of a locking pliers according to the present invention in its closed, locked position on a workpiece with a turning force applied to the pliers.
Figure 4:
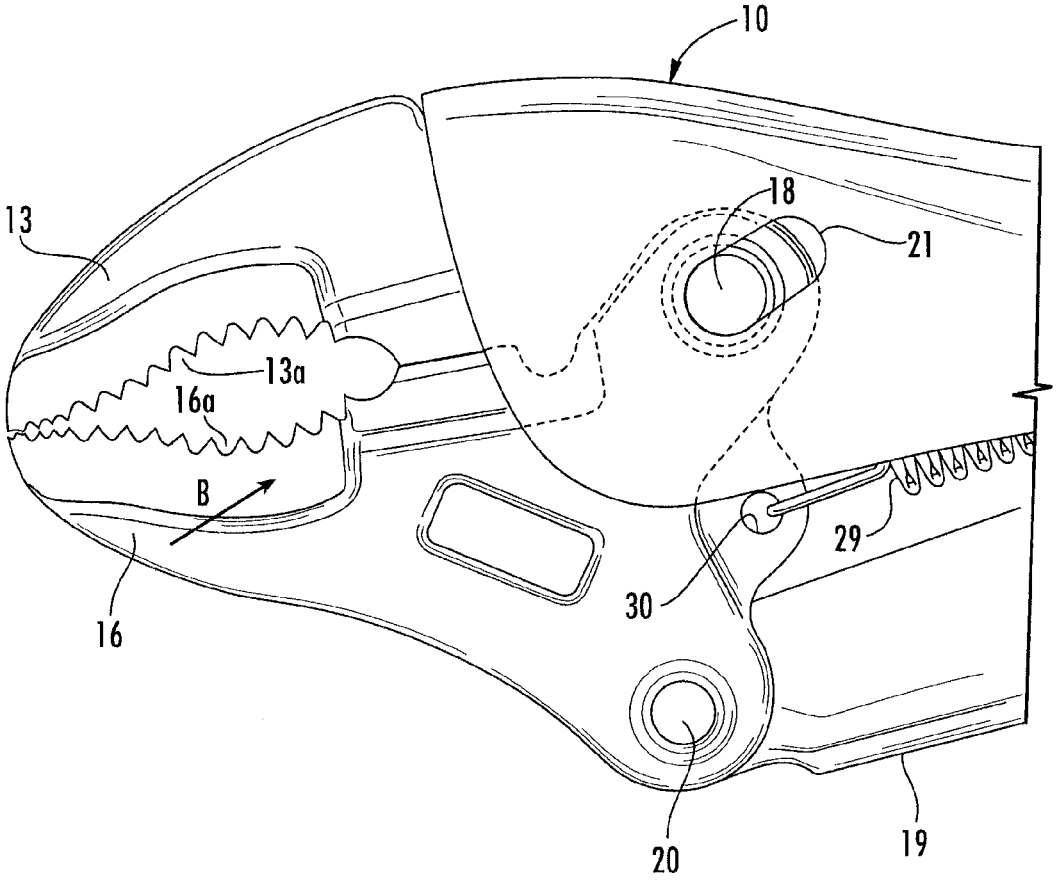
FIG. 4 is a more detailed side view of the pliers of FIG. 1.

When the jaws 13 and 16 are closed and locked on a work piece and a turning force is applied in the direction of arrow A (FIG. 3), the pivot pin 18 moves further toward the rear of slot 21. Because pivot pin 18 is fixed in position on jaw 16, as the pivot pin 18 moves in slotted aperture 21, the movable jaw 16 is also moved slightly rearward as represented by arrow B. As the movable jaw 16 moves in the direction of arrow B a component of the movement of movable jaw 16 is toward fixed jaw 13 in the direction of arrow C. As the movable jaw 16 moves rearward, the angle of slot 21 forces the movable jaw 16 toward the fixed jaw 13 such that the gripping force exerted on the work piece P is increased as the turning force applied to the pliers increases. As a result, the pliers 1 resist slipping on the work piece at higher applied torques.

Figure 5:
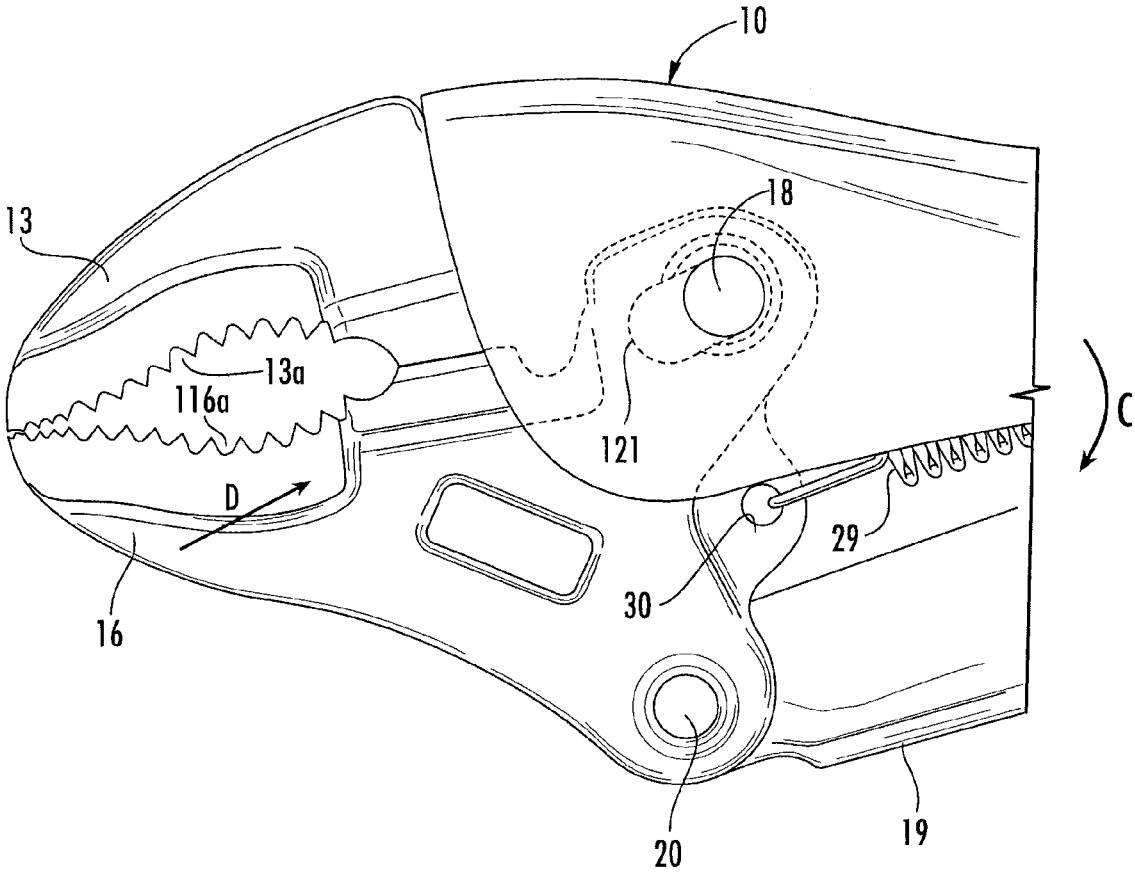
FIG. 5 is a detailed side view of another embodiment of the pliers with the slot for the movable pivot in the movable jaw instead of the fixed assembly.

In another embodiment shown in FIG. 5, the pivot pin 118 is retained in a fixed position relative to the fixed assembly 10. A slotted aperture 121 is formed in the movable jaw 116 and receives pivot pin 118 where the pivot pin 118 is normally biased toward the rear of the slotted aperture 121. While the aperture is described as a slot, the aperture 121 can have a different shape than the slot illustrated in the figures provided the shape allows the pivot pin to move such that the movable jaw moves toward the fixed jaw. In this embodiment, when the pliers are first locked on a work piece the movable jaw 116 having slot 121 moves slightly rearward but pivot pin 118 does not move all of the way to the front end of the slot 121. The movable jaw 116 rotates slightly around pivot pin 20 (clockwise as viewed in FIG. 5) to allow movement of slot 121 (and jaw 116) relative to pivot pin 118. The movable jaw 116 moves rearward and, due to the angle of the slot 21 relative to the fixed jaw 13, jaw 116 also moves toward the fixed jaw 13. As the movable jaw 116 moves toward the fixed jaw 13, the gripping force on the work piece increases as the distance between the jaws (or the volume of the space between the jaws) decreases.

When the jaws 13 and 116 are closed and locked on a work piece and a turning force is applied in the direction of arrow C, jaw 116 moves further rearward as slot 121 moves relative to pivot pin 118 (pivot pin 118 moves toward the front of slot 121). As the movable jaw 116 moves rearward, the angle of slot 121 forces the movable jaw 116 to move toward the fixed jaw 13 in the direction of arrow D such that the gripping force exerted on the work piece P is increased as the turning force applied to the pliers increases. As a result, the pliers 1 resist slipping on the work piece at higher applied torques. To increase the gripping effect of the pliers, the gripping faces 13*a* and 116*a* are configured such that the distance between the jaws becomes smaller toward the front of the pliers. As a result, as the jaw 116 moves rearward, the distance between the jaws also narrows due to the geometry of the jaws as well as the movement of jaw 116 toward jaw 13.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A lockable pliers comprising:

a fixed assembly comprising a first handle supporting a first jaw, said first jaw defining a front of the pliers and said first handle defining a rear of the pliers;

a second movable jaw rotatable about a fixed pivot relative to the first jaw between an open position and a closed, locked position, said first jaw and said second jaw defining a line extending through the center of the first jaw and the second jaw when the first jaw and the second jaw are closed;

a second handle movable relative to the first handle, said second handle connected to the second jaw at the fixed pivot;

a locking mechanism for locking the second jaw in the closed, locked position;

a movable pivot connecting the second jaw to the fixed assembly such that a force exerted by a workpiece on the second jaw rotates the movable jaw about the fixed pivot and moves the movable pivot relative to the fixed assembly when the second jaw is in the closed, locked position and a torque is applied to the pliers such that the second jaw moves towards the first jaw, said movable pivot comprises a pivot pin connected to said second jaw and located in an aperture in the fixed assembly, said aperture having an oval shape where the long axis of the aperture extends at an angle relative to said line toward the rear of the pliers such that said pivot pin is movable in said aperture.

2. The locking pliers of claim 1 wherein said pivot pin is normally located in the aperture towards the front of the pliers.

3. The locking pliers of claim 2 wherein the pivot pin moves toward the rear of the pliers when a torque is applied to the pliers.

4. The locking pliers of claim 1 wherein said angle is approximately 15°.

5. A method of gripping a workpiece with a locking pliers comprising:

providing a fixed assembly comprising a first handle supporting a first jaw;

providing a second movable jaw rotatable about a fixed pivot relative to the first jaw between an open position and a closed, locked position, said first jaw and said second jaw defining a line extending through the center of the first jaw and the second jaw when the first jaw and the second jaw are closed;

providing a second handle movable relative to the first handle, said second handle connected to the second jaw at a fixed pivot;

providing a locking mechanism for locking the second jaw in the closed, locked position;

providing a movable pivot connecting the second jaw to the fixed assembly, said movable pivot comprises a pivot pin connected to said second jaw and located in an aperture in the fixed assembly, said aperture having an oval shape where the long axis of the aperture extends at an angle relative to said line toward the rear of the pliers;

applying a torque to the pliers; and allowing the movable jaw to rotate about the fixed pivot and the pivot pin to move in said aperture relative to the fixed assembly when the second jaw is in the closed, locked position and the torque is applied to the pliers such that a force exerted by a workpiece on the second jaw by a workpiece clamped between the first jaw and the second jaw moves the second jaw towards the first jaw.

6. A method of gripping a workpiece with a locking pliers comprising:

providing a fixed assembly comprising a first handle supporting a first jaw;

providing a second movable jaw movable relative to the first jaw between an open position and a closed, locked position, said first jaw and said second jaw defining a line extending through the center of the first jaw and the second jaw when the first jaw and the second jaw are closed;

providing a second handle movable relative to the first handle, said second handle connected to the second jaw at a fixed pivot;

providing a locking mechanism for locking the second jaw in the closed, locked position;

providing a movable pivot connecting the second jaw to the fixed assembly, said movable pivot comprises a pivot pin connected to said fixed assembly and located in an aperture in the second jaw, said aperture having an oval shape where the long axis of the aperture extends at an angle relative to said line toward the rear of the pliers;

applying a torque to the pliers; and allowing the movable jaw to rotate about the fixed pivot and the pivot pin to move in said aperture relative to said second jaw such that said second jaw moves relative to the fixed assembly toward the first jaw when the second jaw is in the closed, locked position and the torque is applied to the pliers such that a force exerted by a workpiece on the second jaw by a workpiece clamped between the first jaw and the second jaw moves the second jaw towards the first jaw.

7. A lockable pliers comprising:

a fixed assembly comprising a first handle disposed toward a rear of the fixed assembly supporting a first jaw disposed toward a front of the fixed assembly;

a second movable jaw rotatable about a fixed pivot relative to the first jaw between an open position and a closed, locked position, said first jaw and said second jaw defining a line extending through the center of the first jaw and the second jaw when the when the first jaw and the second jaw are closed;

a second handle movable relative to the first handle, said second handle connected to the second jaw at the fixed pivot;

a locking mechanism for locking the second jaw in the closed, locked position;

a pivot pin connected to one of said fixed assembly and said second jaw and being received in an aperture formed in the other of said fixed assembly and said second jaw to connect the second jaw to the fixed assembly, said aperture having a first end disposed toward the front and a second end disposed toward the rear, said pin engaging said aperture, said aperture having an oval shape where the long axis of the aperture extends at an angle relative to said line toward the rear of the pliers such that when the second jaw is in the closed, locked position on a workpiece the pin is disposed toward one of the first end and second end of the aperture and the pivot pin can move relative to the second jaw from the one of the first end and second end of the aperture toward the other of the first end and second end of the aperture when the second jaw is in the closed, locked position and a torque is applied to the pliers such that a force exerted by a workpiece on the second jaw when clamped between the first jaw and the second jaw rotates the second jaw about the fixed pivot and moves the second jaw toward the first jaw to increase the force exerted by the first jaw and the second jaw on the workpiece.

8. The locking pliers of claim 7 wherein said angle is approximately 15°.

* * * * *